US012152327B2

(12) United States Patent
Atsumi

(10) Patent No.: US 12,152,327 B2
(45) Date of Patent: Nov. 26, 2024

(54) SEWING SYSTEM, SEWING MACHINE, AND MANAGEMENT DEVICE

(71) Applicant: JUKI CORPORATION, Tama (JP)

(72) Inventor: Tadashi Atsumi, Tama (JP)

(73) Assignee: JUKI CORPORATION, Tama (JP)

( * ) Notice: Subject to any disclaimer, the term of this patent is extended or adjusted under 35 U.S.C. 154(b) by 188 days.

(21) Appl. No.: 16/258,950

(22) Filed: Jan. 28, 2019

(65) Prior Publication Data

US 2019/0233995 A1 Aug. 1, 2019

(30) Foreign Application Priority Data

Jan. 29, 2018 (JP) ..... JP2018-012301

(51) Int. Cl.
*D05B 19/08* (2006.01)
*D05B 19/12* (2006.01)

(52) U.S. Cl.
CPC ..... *D05B 19/08* (2013.01); *D05B 19/12* (2013.01)

(58) Field of Classification Search
CPC ..... D05B 19/08; D05B 19/12
USPC ..... 700/136, 138
See application file for complete search history.

(56) References Cited

U.S. PATENT DOCUMENTS 4,369,722 A * 1/1983 Nishida ..... D05B 21/00 112/103
4,899,287 A * 2/1990 Hulshoff ..... G05B 19/0426 112/457
4,932,342 A 6/1990 Hisatake et al.
5,229,949 A * 7/1993 Kondo ..... D05B 25/00 112/470.01
5,253,599 A * 10/1993 Hashiride ..... D05B 25/00 112/155
5,517,404 A * 5/1996 Biber ..... D01H 13/32 700/130

(Continued)

FOREIGN PATENT DOCUMENTS

CN 1376991 A 10/2002
CN 101363167 A 2/2009

(Continued)

OTHER PUBLICATIONS

European Seach Report dated Mar. 20, 2019 for corresponding European Patent Application No. 19154073.1.

(Continued)

*Primary Examiner* — Grace Huang
(74) *Attorney, Agent, or Firm* — Faegre Drinker Biddle & Reath LLP

(57) ABSTRACT

A sewing system includes a plurality of sewing machines and a management device which manages the plurality of sewing machines. Each of the plurality of sewing machines including a memory which stores parameter data obtained by digitizing an adjustment amount of an adjustment function of a seam, and an adjustment unit which adjusts the adjustment function of the seam by the adjustment amount corresponding to the parameter data in the memory. The management device including a management unit which separately manages the parameter data of the plurality of sewing machines, and a delivery unit which simultaneously delivers the parameter data to each of the plurality of sewing machines.

10 Claims, 12 Drawing Sheets

(56) References Cited

U.S. PATENT DOCUMENTS 5,831,858 A * 11/1998 Wakayama ..... D05B 19/06 700/138
5,873,317 A * 2/1999 Komuro ..... D05B 19/12 112/155
5,881,662 A * 3/1999 Bastian ..... G07C 9/20 112/102.5
5,921,194 A * 7/1999 Komuro ..... D05B 19/105 112/102.5
5,954,005 A * 9/1999 Sekine ..... D05B 19/12 112/155
5,983,817 A * 11/1999 Sekine ..... D05B 19/12 112/102.5
6,487,473 B1 * 11/2002 Beck ..... B26D 5/00 700/134
6,510,360 B1 * 1/2003 Kaymer ..... D05B 19/08 112/475.19
6,631,306 B2 * 10/2003 Funahashi ..... D05C 5/00 700/138
6,637,358 B2 * 10/2003 Cramer ..... D05B 19/08 112/470.04
6,675,056 B1 * 1/2004 Black, Jr. ..... H05K 13/084 700/116
6,694,211 B2 * 2/2004 Hosel ..... G05B 19/409 112/155
6,780,876 B2 * 8/2004 Froelich ..... A01N 43/40 514/315
6,836,617 B1 * 12/2004 Parulski ..... H04N 1/00973 396/311
6,925,351 B2 * 8/2005 Larson ..... D05B 19/06 700/138
7,849,807 B2 * 12/2010 Suzuki ..... D05B 3/08 112/272
7,937,829 B2 * 5/2011 Petersen ..... H05K 1/0293 340/568.1
8,051,381 B2 * 11/2011 Ebrom ..... H04L 69/26 700/83
8,069,091 B1 * 11/2011 Callen, Jr. ..... G06Q 30/0603 705/26.5
8,099,185 B2 * 1/2012 Dickerson ..... D05B 19/04 700/134
8,170,708 B2 * 5/2012 Goldman ..... D05C 5/02 700/138
8,180,475 B2 * 5/2012 Taguchi ..... D05C 5/04 112/155
8,195,328 B2 * 6/2012 Mallett ..... G16H 40/67 221/102
9,435,062 B2 * 9/2016 Kongo ..... D05B 19/04
9,951,449 B2 * 4/2018 Gieskes ..... D05B 19/12
10,147,248 B2 * 12/2018 Graafstra ..... G07C 9/257
10,351,982 B2 * 7/2019 deGuzman ..... G06Q 30/0621
10,390,571 B2 * 8/2019 McKeen ..... A41C 3/128
10,563,330 B2 * 2/2020 Blenis, Jr. ..... D05B 19/10
10,626,534 B2 * 4/2020 Matsushima ..... D05B 29/06
10,753,020 B2 * 8/2020 Barea ..... D01H 13/00
10,889,928 B2 * 1/2021 Fujimoto ..... D05B 19/12
10,914,025 B2 * 2/2021 Kobayashi ..... D05B 19/12
11,321,067 B2 * 5/2022 Okuno ..... G06F 11/327
11,940,781 B2 * 3/2024 Atsumi ..... G07C 3/00
2001/0004717 A1 6/2001 Zhang et al.
2002/0129753 A1 9/2002 Cramer et al.
2005/0060058 A1 * 3/2005 Cameron ..... D05B 19/08 700/138
2006/0117922 A1 * 6/2006 Causse ..... B26D 7/20 83/76.3
2008/0147231 A1 * 6/2008 Fernandez ..... A41H 3/007 700/138
2010/0228383 A1 9/2010 Taguchi
2011/0184812 A1 * 7/2011 Stoulil ..... G07F 9/001 705/14.66
2011/0295410 A1 12/2011 Yamada et al.
2012/0245727 A1 * 9/2012 Naka ..... D05B 19/08 112/470.01
2014/0277683 A1 * 9/2014 Gupta ..... G06F 30/00 700/132
2016/0010252 A1 * 1/2016 Yamanashi ..... D05B 19/12 112/102.5
2016/0060799 A1 * 3/2016 Kongo ..... D05B 19/02 112/102.5
2021/0232127 A1 * 7/2021 Atsumi ..... G05B 19/41875
2021/0301440 A1 * 9/2021 Ishihara ..... D05B 19/04

FOREIGN PATENT DOCUMENTS

CN 101469486 A 7/2009
JP H04-126188 A 4/1992
JP H07-194880 A 8/1995
JP 2001-170383 A 6/2001
JP 2001-170384 A 6/2001
JP 2002-177673 A 6/2002
JP 2006-318365 A 11/2006
JP 2009-039393 A 2/2009
JP 2012-200265 A 10/2012

OTHER PUBLICATIONS

Notification of First Office Action issued Sep. 3, 2021 in Chinese Patent Application No. 201910086347.5 (9 pages) with an English translation (12 pages).
Second Office Action issued Mar. 23, 2022 in Chinese Patent Application No. 201910086347.5 (8 pages) with an English translation (9 pages).
Communication pursuant to Article 94(3) EPC issued Jan. 18, 2022 in European Patent Application No. 19 154 073.1.
Notice of Reasons for Refusal issued Nov. 30, 2021 in Japanese Patent Application No. 2018-012301 (4) pages with an English translation (4 pages).
Decision of Refusal issued Jun. 21, 2022 in Japanese Patent Application No. 2018-012301 (4 pages) with an English translation (4 pages).
Chinese Office Action issued Aug. 11, 2022 in corresponding Chinese Patent Application No. 201910086347.5, including English-language translation.
Chinese Office Action issued Dec. 26, 2022 in corresponding Chinese Patent Application No. 201910086347.5, including English-language translation.
European Office Action issued Jun. 26, 2023 in Application No. 19154073.1.
Japanese Office Action issued Dec. 26, 2023 in Application No. 2018-012301.

* cited by examiner

MANAGEMENT TABLE T7

| | | |
|---|---|---|
| M1 | MEMORY SWITCH 1 | FIRMWARE 1 |
| M2 | MEMORY SWITCH 2 | FIRMWARE 2 |
| M3 | MEMORY SWITCH 3 | FIRMWARE 3 |

SEWING SYSTEM, SEWING MACHINE, AND MANAGEMENT DEVICE

CROSS-REFERENCE TO RELATED APPLICATIONS

The present application claims priority under 35 U.S.C. § 119 to Japanese Patent Application No. 2018-012301, filed Jan. 29, 2018. The contents of this application are incorporated herein by reference in their entirety.

TECHNICAL FIELD

The present invention relates to a sewing system for controlling a sewing operation, a sewing machine, and a management device.

BACKGROUND ART

In the related art, a sewing system in which a sewing machine and a computer are connected to each other via a network are known as a sewing system (refer to JP-A-2012-200265). In the sewing system described in JP-A-2012-200265, a sewing machine reads various pieces of data such as an embroidery pattern from the computer, and a pattern is formed on a work cloth while referring to the various pieces of data. In this case, the sewing machine is provided with an operation panel, and the embroidery patterns are displayed as thumbnails on a display of the operation panel. By selecting the embroidery pattern on the operation panel of the sewing machine, the sewing machine accesses the computer and a sewing operation corresponding to the selected embroidery pattern is executed.

However, in the sewing system described in JP-A-2012-200265, it has been necessary to take various pieces of data from the sewing machine side to the computer by operating the operation panel. In addition, in general, as an operator adjusts sewing machines one by one after confirming work contents or a product cloth, it becomes necessary to take a long time to operate a plurality of sewing machines, and it is a burden work for the operator. Further, there was a risk that setting mistakes occur due to carelessness of the operator.

SUMMARY

An aspect of the present invention provides a sewing system, a sewing machine, and a management device which can improve a work efficiency of an operator and prevent setting mistakes by the operator.

A sewing system includes a plurality of sewing machines and a management device which manages the plurality of sewing machines. Each of the plurality of sewing machines including a memory which stores parameter data obtained by digitizing an adjustment amount of an adjustment function of a seam, and an adjustment unit which adjusts the adjustment function of the seam by the adjustment amount corresponding to the parameter data in the memory. The management device including a management unit which separately manages the parameter data of the plurality of sewing machines, and a delivery unit which simultaneously delivers the parameter data to each of the plurality of sewing machines.

A sewing machine managed by a management device includes a memory that stores parameter data obtained by digitizing an adjustment amount of an adjustment function of a seam, and an adjustment unit that adjusts the adjustment function of the seam with an adjustment amount corresponding to the parameter data in the memory. The parameter data of a plurality of the sewing machines separately managed by the management device is simultaneously delivered. Each of the parameter data of the plurality of the sewing machines is stored in each of the memory of the plurality of sewing machines. Each of the adjustment function of the seam of the plurality of the sewing machines is adjusted by the parameter data in the memory.

A management device that manages a plurality of sewing machines, includes a management unit that separately manages parameter data of the plurality of sewing machines obtained by digitizing an adjustment amount of an adjustment function of a seam, and a delivery unit that simultaneously delivers the parameter data to each sewing machine. The adjustment function of the seam is adjusted by the adjustment amount corresponding to the parameter data with respect to the plurality of sewing machines by simultaneously delivering the parameter data.

According to the configurations, the parameter data is simultaneously delivered to the plurality of sewing machines from the management device, and the adjustment function of the seam of each sewing machine is automatically adjusted by an appropriate adjustment amount. For each sewing machine, the operator does not need to manually adjust the adjustment function of the seam, and the operator does not need to operate the sewing machine to obtain the parameter data. Accordingly, even when the plurality of sewing machines are installed in the sewing line, it is possible to shorten the work time of the adjustment work of the plurality of sewing machines, and to improve the work efficiency, and it is possible to prevent the setting mistakes due to carelessness of the operator.

The management device may include a collection unit that collects current parameter data from each of the plurality of sewing machines, and manages the current parameter data of each of the plurality of sewing machines. According to the configuration, the current parameters collected from each sewing machine can be used for the next production for each sewing machine.

The management unit may manage the parameter data of the plurality of sewing machines for each step in a sewing line including a plurality of steps. The delivery unit may deliver the parameter data simultaneously to the sewing machine in each step. According to the configuration, it is possible to adjust the adjustment function of the seam by the adjustment amount appropriate for each step.

The management unit may manage the parameter data of the plurality of sewing machines for each item number. The delivery unit may deliver the parameter data simultaneously to each of the sewing machines according to the item number. According to the configuration, it is possible to adjust the adjustment function of the seam by the adjustment amount appropriate for each item number.

The sewing system may further includes a reading unit that reads the item number from a sewing target carried into the sewing machine. The management device may deliver the parameter data separately to each of the plurality of sewing machines by the delivery unit according to the item number read by the reading unit. According to the configuration, since the parameter data is separately delivered to the sewing machine each time the item number is changed, it is possible to make the real-time adjustment function of the seam variable according to the item number of the sewing target carried into the sewing machine.

The management unit may manage the parameter data of the plurality of sewing machines for each operator. The delivery unit may deliver the parameter data simultaneously to each of the sewing machines according to operator identification information for identifying the operator of each of the sewing machines. According to the configuration, it is possible to adjust the adjustment function of the seam by the adjustment amount corresponding to the skill of the operator.

In addition to the parameter data, the delivery unit may deliver at least one of vector pattern data indicating an embroidery pattern, a memory switch indicating a sewing machine control option, continuous stitch data for controlling automatic sewing of a continuous sewing, cycle stitch data for controlling an automatic sewing of a pattern seamer, and firmware, to the plurality of sewing machines. According to the configuration, it is possible to further improve the working efficiency by simultaneously delivering at least one of vector pattern data, memory switch, continuous sewing data, cycle sewing data, and firmware, in addition to parameter data, to a plurality of sewing machines. More specifically, each of the plurality of sewing machines are connected to a respective terminal such that said terminal is connected to the management device, and such that the plurality of sewing machines are capable of communicating bidirectionally. Each terminal includes a reading unit that reads the item number from a sewing target carried into the sewing machine and that reads operator identification information of an operator of the sewing machine. The delivery unit delivers according to the operator identification information for identifying the operator of each of the sewing machines as read out by each reading unit.

According to the present invention, by simultaneously delivering the parameter data from the management device to the plurality of sewing machines, it is possible to improve the working efficiency and to prevent the setting mistakes by the operator.

DETAILED DESCRIPTION OF EMBODIMENTS

Figure 1:
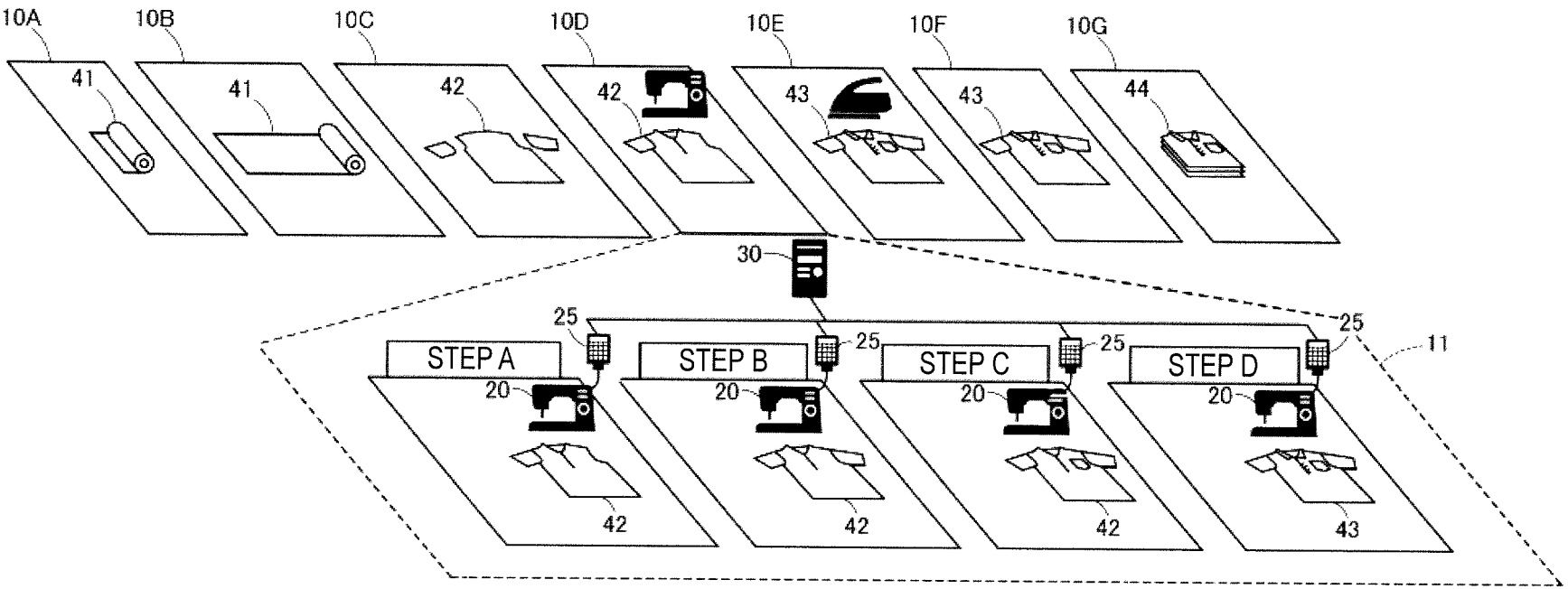
FIG. 1 is an overall schematic view of a sewing factory according to an embodiment.

Hereinafter, a sewing system of an embodiment will be described with reference to the attached drawings. FIG. 1 is an overall schematic view of a sewing factory according to the embodiment. In addition, the sewing system of the embodiment is merely an example and can be appropriately changed.

As illustrated in FIG. 1, in the sewing factory into which a sewing system 11 is introduced, an arrival inspection facility 10A, a stretching facility 10B, a cutting facility 10C, a sewing facility 10D, a finishing facility 10E, an inspection facility 10F, a packing and shipping facility 10G are provided. Scratches or dirt are inspected on a cloth 41 which is a sewing target by the arrival inspection facility 10A, and the cloth 41 is spread on a workbench by the stretching facility 10B. The cloth 41 is cut into various parts 42 by the cutting facility 10C, the various parts 42 after the cutting are sewn together by the sewing facility 10D, and ironing is applied to a workpiece 43 sewn up by the finishing facility 10E. Skipping stitch or the like of the workpiece 43 is inspected by the inspection facility 10F, and the workpiece 43 is packed and shipped as a product 44 by the packing and shipping facility 10G.

A plurality of sewing machines 20 are arranged in the sewing facility 10D to form a sewing line. The sewing line is made up of a plurality (four in the embodiment) of steps A to D for each stitching location of the parts 42, and the various parts 42 go through each of the steps A to D of the sewing line to produce the workpiece 43. The plurality of sewing machines 20 are connected to the management device 30 via a terminal 25, and the plurality of sewing machines 20 are managed by the management device 30. In addition, an automatic guided vehicle (AGV) (not illustrated) is provided in the sewing factory, the AGV makes it possible to perform unmanned conveyance between each of the facilities 10A to 10G or unmanned conveyance between each of the steps A to D of the sewing line.

Incidentally, when adjusting the seam with an analog sewing machine, an operator has to manually adjust an adjustment function of the seam, such as feed dog height, feed pitch, feed trajectory, pressing pressure, or thread tension. The adjustment of the sewing machine is largely influenced by the work contents of each step or the material or the thickness of the cloth, and sufficient skill is required for the operator. For example, it is necessary to change the pressing pressure for a slippery cloth and a non-slip cloth, and it is necessary to change the thread tension for a soft cloth and a hard cloth. In particular, since there is a slight difference in the pressing pressure and the like for each sewing machine, even when the work contents or the cloth are the same, the adjustment amount should be finely adjusted for each sewing machine.

Therefore, depending on the intuition or experience of the operator, the operator who is inexperienced has variations in the adjustment for each sewing machine, and further, there is a risk that the adjustment mistakes occur due to carelessness of the operator. In this regard, when a digital sewing machine is employed, it is possible to digitize and store feed dog height, feed pitch, feed trajectory, pressing pressure, thread tension, and the like, as numerical values. Therefore, it is possible to faithfully realize the previous adjustment contents for each sewing machine, and to adjust each sewing machine during a short period of time without relying on the intuition or experience of the operator similar to the analog sewing machine.

However, even with a digital sewing machine, it is not possible to recognize the work contents or the type of the carried-in cloth in the sewing line. In general, the operator adjusts the sewing machines one by one after confirming the work contents or the cloth of the product, and it becomes necessary to take a long time to operate the plurality of sewing machines. Here, in the embodiment, the plurality of sewing machines 20 are separately managed by the management device 30, the parameter data obtained by digitizing the adjustment amount of the adjustment function of the seam is simultaneously delivered from the management device 30 to the plurality of sewing machines 20, and the work efficiency is improved and the setting mistakes by the operator are prevented.

Figure 2:
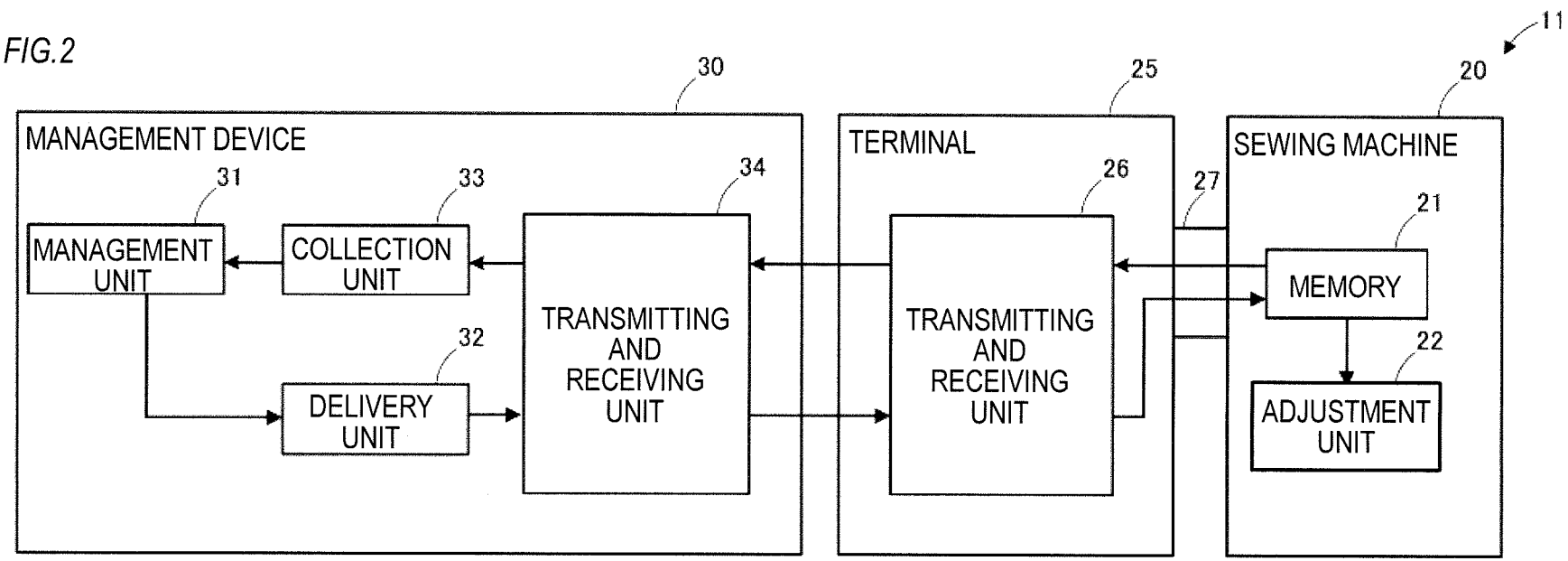
FIG. 2 is a block diagram of a sewing system according to the embodiment.

Hereinafter, with reference to FIG. 2, a control configuration of the sewing system will be described. FIG. 2 is a block diagram of the sewing system according to the embodiment. In addition, the sewing machine is described in a simplified manner in the block diagram of FIG. 2, but it is assumed that the sewing machine includes a configuration generally provided by the sewing machine.

As illustrated in FIG. 2, the sewing system 11 is configured by connecting the plurality (only one is illustrated in FIG. 2) of sewing machines 20 to the management device 30 via the terminal 25. The sewing machine 20 and the terminal 25 are connected to each other by a serial communication cable 27. Alternatively, the terminal 25 and the sewing machine 20 are connected to each other by wired communication or wireless communication. In a case of the wireless communication by terminal 25 and the sewing machine 20, the terminal 25 is connected to the management device 30 via a wireless access point (not illustrated) by the wireless communication. In this manner, in the sewing system 11, the plurality of sewing machines 20 and management device 30 are connected to each other via the terminal 25 so as to be capable of communicating bidirectionally.

In addition, the terminal 25 is not limited as long as the terminal connects the sewing machine 20 and the management device 30 to each other, and may be configured, for example, by a tablet terminal or an operation panel of the sewing machine 20. Further, the terminal 25 transfers various pieces of arrived data without delay, and in a case where a transfer destination is busy, it is possible to buffer a certain amount of data. In a case where the data is not transferred to the limit of the buffer, an error is displayed on the display and the operator is informed of the data loss. Furthermore, the terminal 25 displays a connection status with the sewing machine 20 on the display and is informed to the operator.

The plurality of sewing machines 20 are provided with a memory 21 and an adjustment unit 22. In the memory 21, sewing machine data, such as vector pattern data indicating an embroidery pattern, a memory switch indicating a sewing machine control option, continuous stitch data for controlling automatic sewing of the continuous sewing, cycle stitch data for controlling the automatic sewing of a pattern seamer, and firmware, are stored in addition to the parameter data obtained by digitizing the adjustment amount of the adjustment function of the seam. By storing the sewing machine data in the memory 21 of the sewing machine 20, the setting contents necessary for the production of the workpiece 43 in the sewing line are reflected on the sewing machine 20.

In the adjustment unit 22, the adjustment function of the seam is adjusted by the adjustment amount corresponding to the parameter data in the memory 21. For example, the adjustment function of the seam includes a feed dog height adjustment function, a feed pitch adjustment function, a feed trajectory adjustment function, a pressing pressure adjustment function, a thread tension adjustment mechanism. By adjusting the adjustment functions by the digitized adjustment values, the sewing operation of the sewing machine 20 is adjusted in accordance with the work contents of the step or the condition of the material and the like of the cloth. In addition, the sewing machine 20 is not limited to a general industrial sewing machine, but may be a robot sewing machine in which the sewing machine is attached to a tip end of a robot arm, in addition to an automatic machine in which multiple steps are fully automated.

The management device 30 is provided with a management unit 31, a delivery unit 32, a collection unit 33, and a transmitting and receiving unit 34. In the management unit 31, the sewing machine data of the plurality of sewing machines 20 are separately managed. In the management unit 31, parameter data, vector pattern data, continuous sewing data, and cycle sewing data for each sewing machine 20 are managed. In addition, in the management unit 31, the memory switch or the firmware is managed for each type of the sewing machine 20. In the management unit 31, a management table for managing the parameter data and the like for each sewing machine, and a management table for managing memory switches and the like for each type are prepared.

For example, the management unit 31 may create, as a management table for the parameter data, at least one of the management table for managing the parameter data for each sewing machine, the management table for managing the parameter data for each step, the management table for managing the parameter data for each item number, and the management table for managing the parameter data for each operator (refer to FIGS. 3 to 8). In addition, in the management table, in addition to the parameter data, vector pattern data, continuous sewing data, and cycle sewing data may also be managed. Furthermore, the management table may be created in which the parameter data is managed by appropriately combining the sewing machine (serial number), the step, the item number, and the operator to each other.

In the delivery unit 32, sewing machine data is simultaneously delivered to each sewing machine 20. In this case, the sewing machine data is selected for each sewing machine 20 from each management table of the management unit 31, and delivered as delivery data from the delivery unit 32 to each sewing machine 20. In the collection unit 33, current sewing machine data is collected from each sewing machine 20. In this case, the current sewing machine data set in the memory 21 is uploaded as uplink data from each sewing machine 20 to the collection unit 33 according to the request simultaneously notified to each sewing machine 20 from the collection unit 33.

The transmitting and receiving unit 34 of the management device 30 is connected to the transmitting and receiving unit 26 of the terminal 25, and various processing, such as modulation and demodulation processing, are applied to the delivered data (downlink data) and uplink data by the transmitting and receiving units 34 and 26. The transmitting and receiving units 34 and 26 are configured of, for example, a transmission and reception circuit, an antenna, an amplifier circuit, and the like. Further, the control configuration of the management device 30, the terminal 25, and the sewing machine 20 is configured of a processor, a memory, or the like that execute various processing. The memory is configured of one or a plurality of storage media, such as read only memory (ROM), random access memory (RAM), and the like, and stores various programs according to the application.

Figure 3:
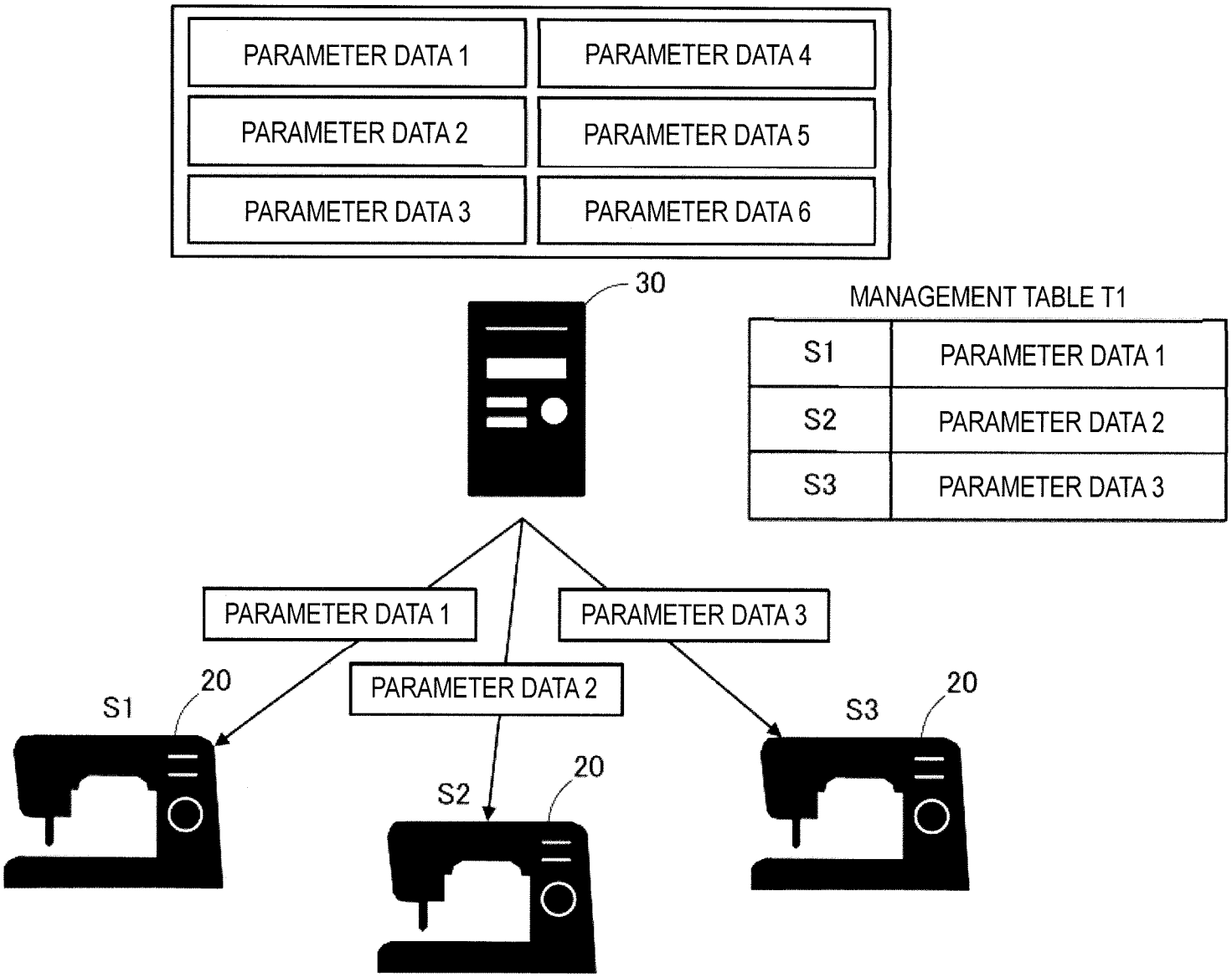
FIG. 3 is a view illustrating an example of data management for each sewing machine according to the embodiment.
Figure 4:
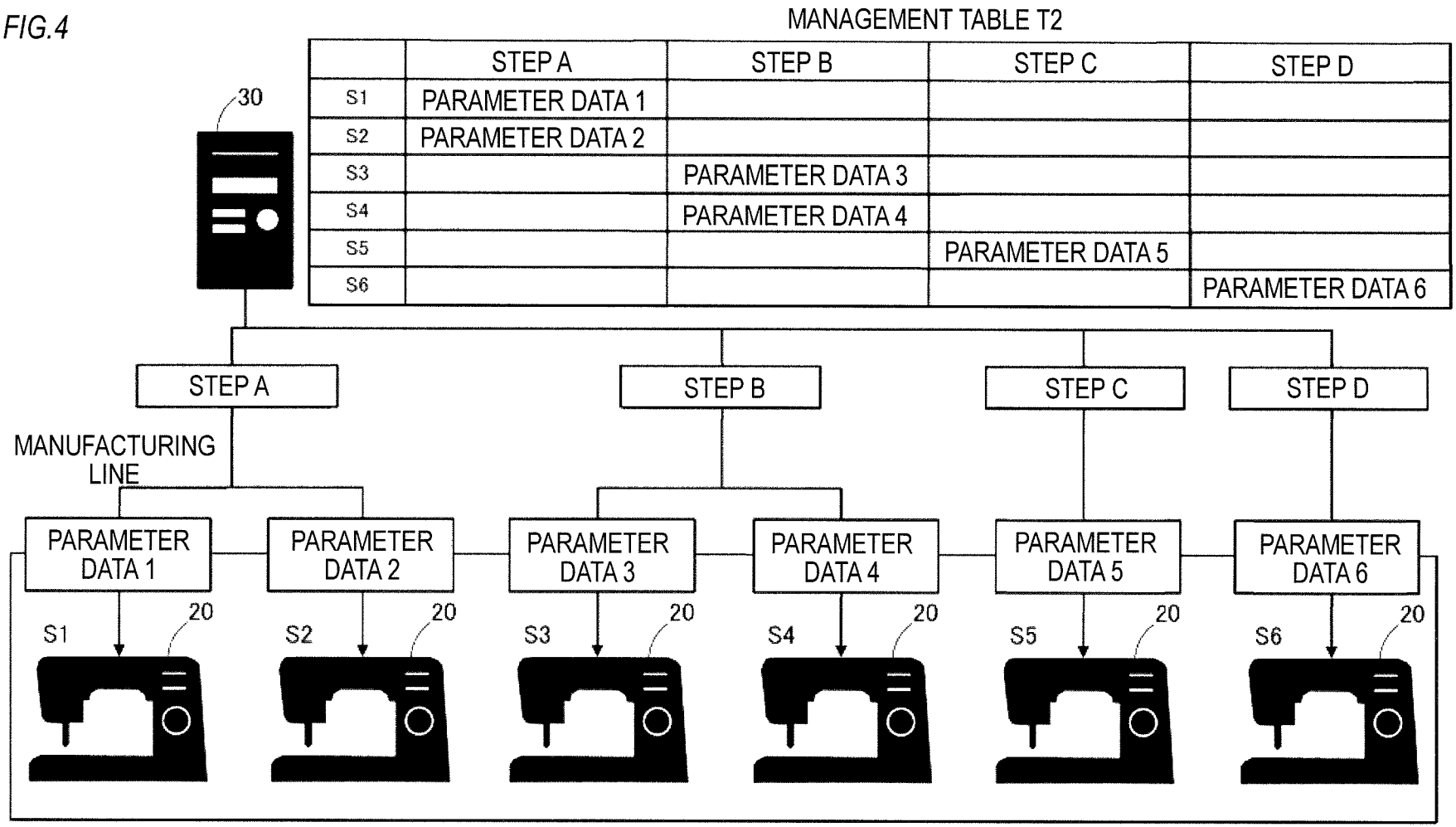
FIG. 4 is a view illustrating an example of data management for each step according to the embodiment.
Figure 5:
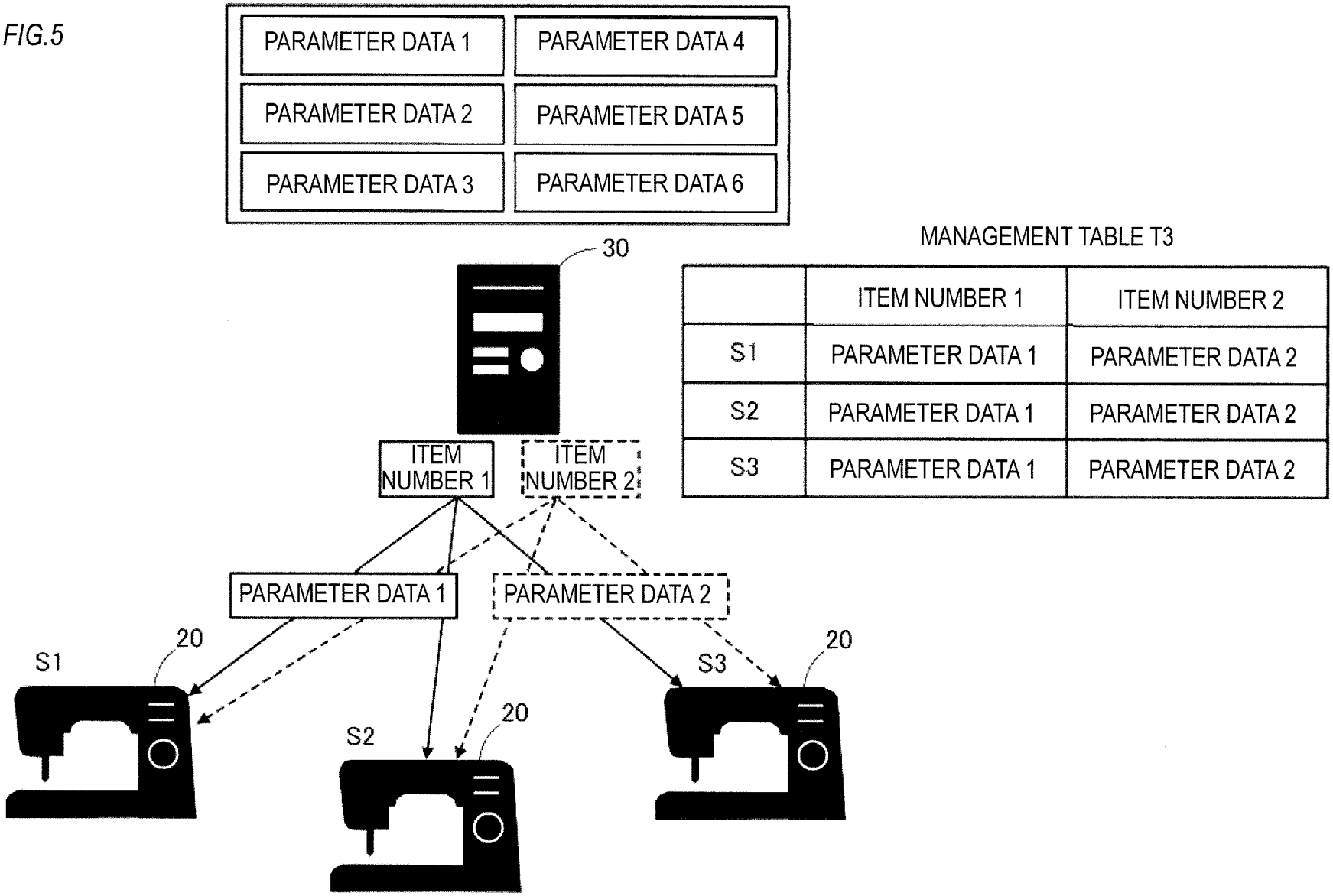
FIG. 5 is a view illustrating an example of data management for each item number according to the embodiment.
Figure 6:
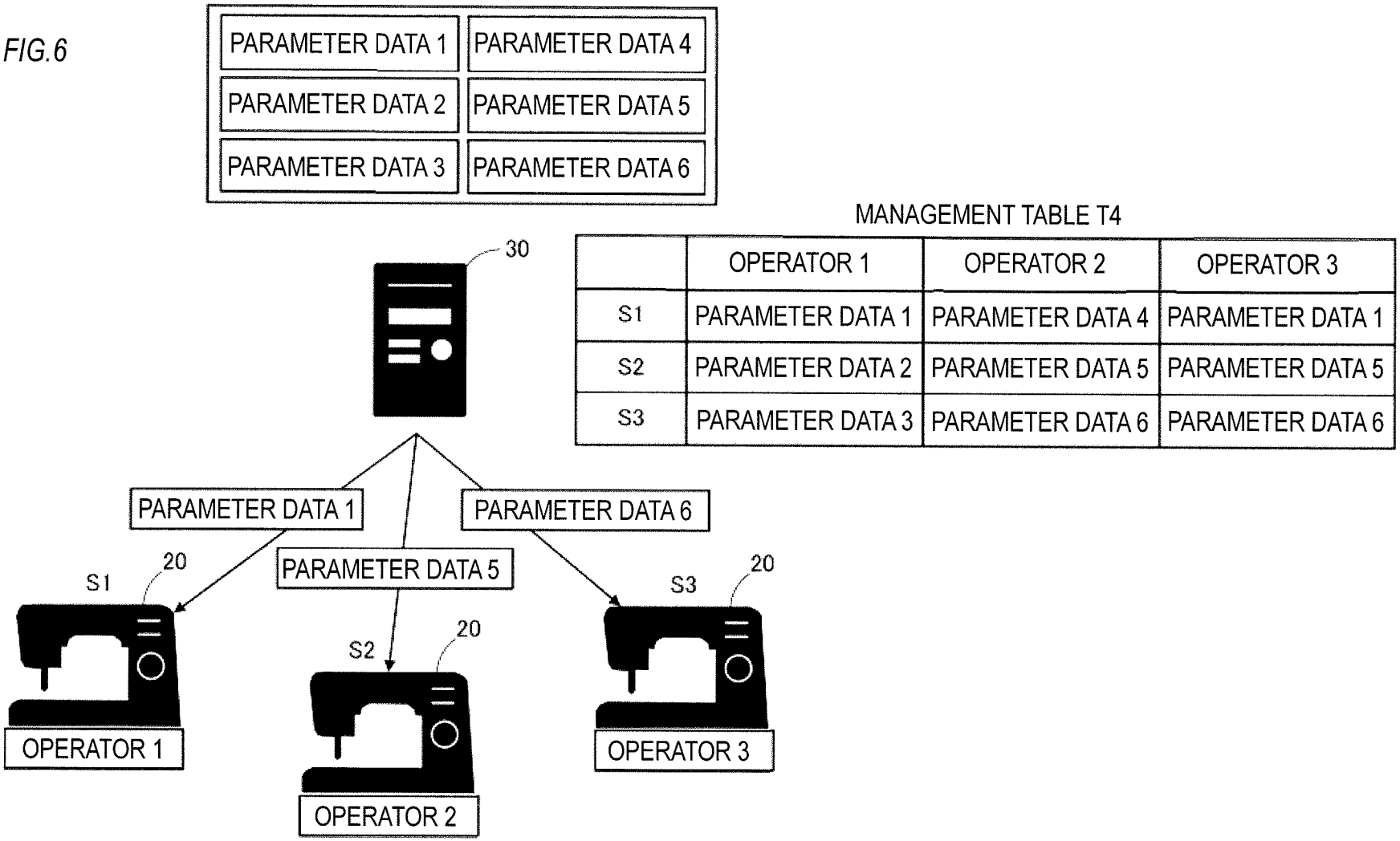
FIG. 6 is a view illustrating an example of data management for each operator according to the embodiment.
Figure 7:
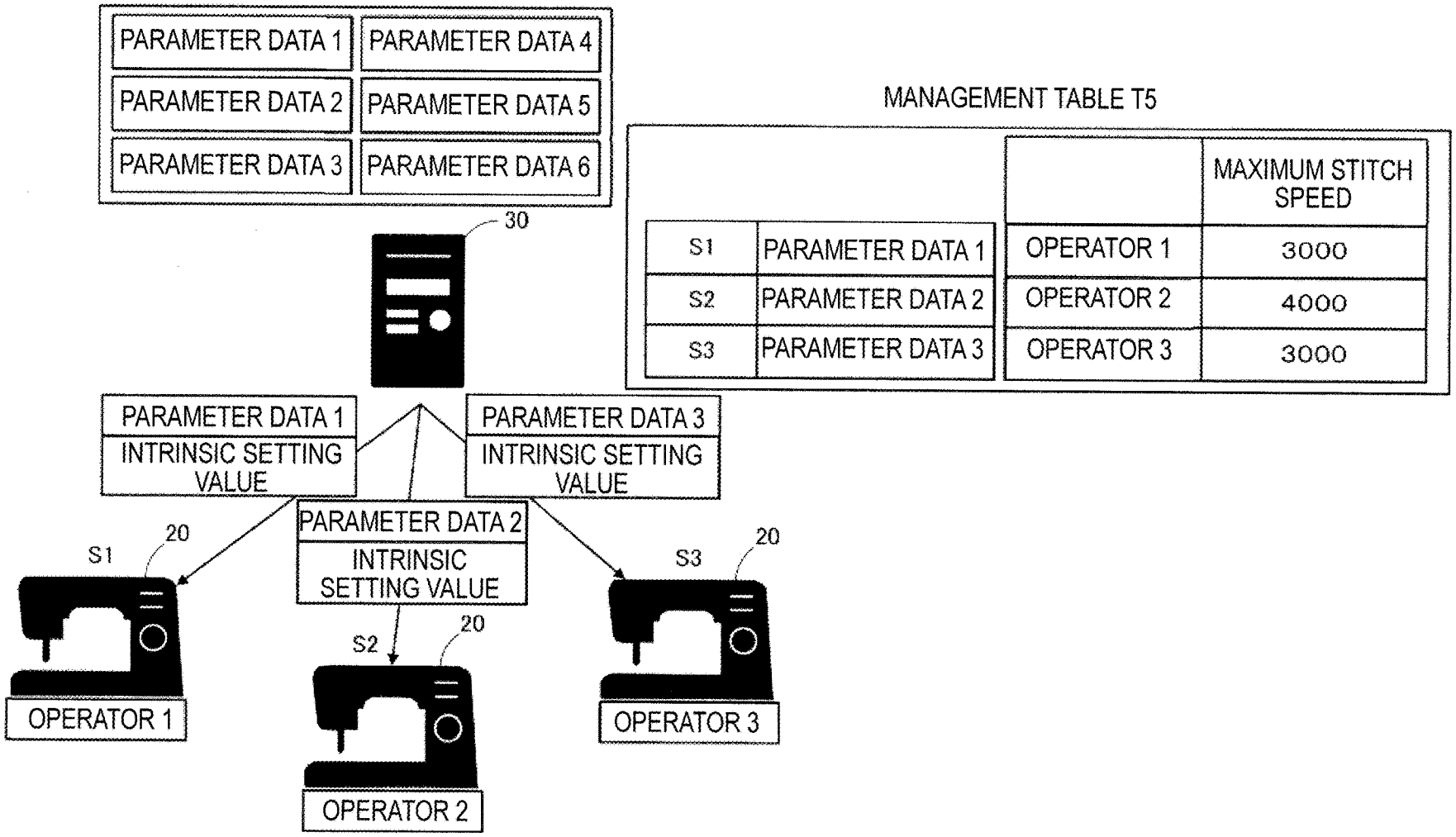
FIG. 7 is a view illustrating another example of the data management for each operator according to the embodiment.
Figure 8:
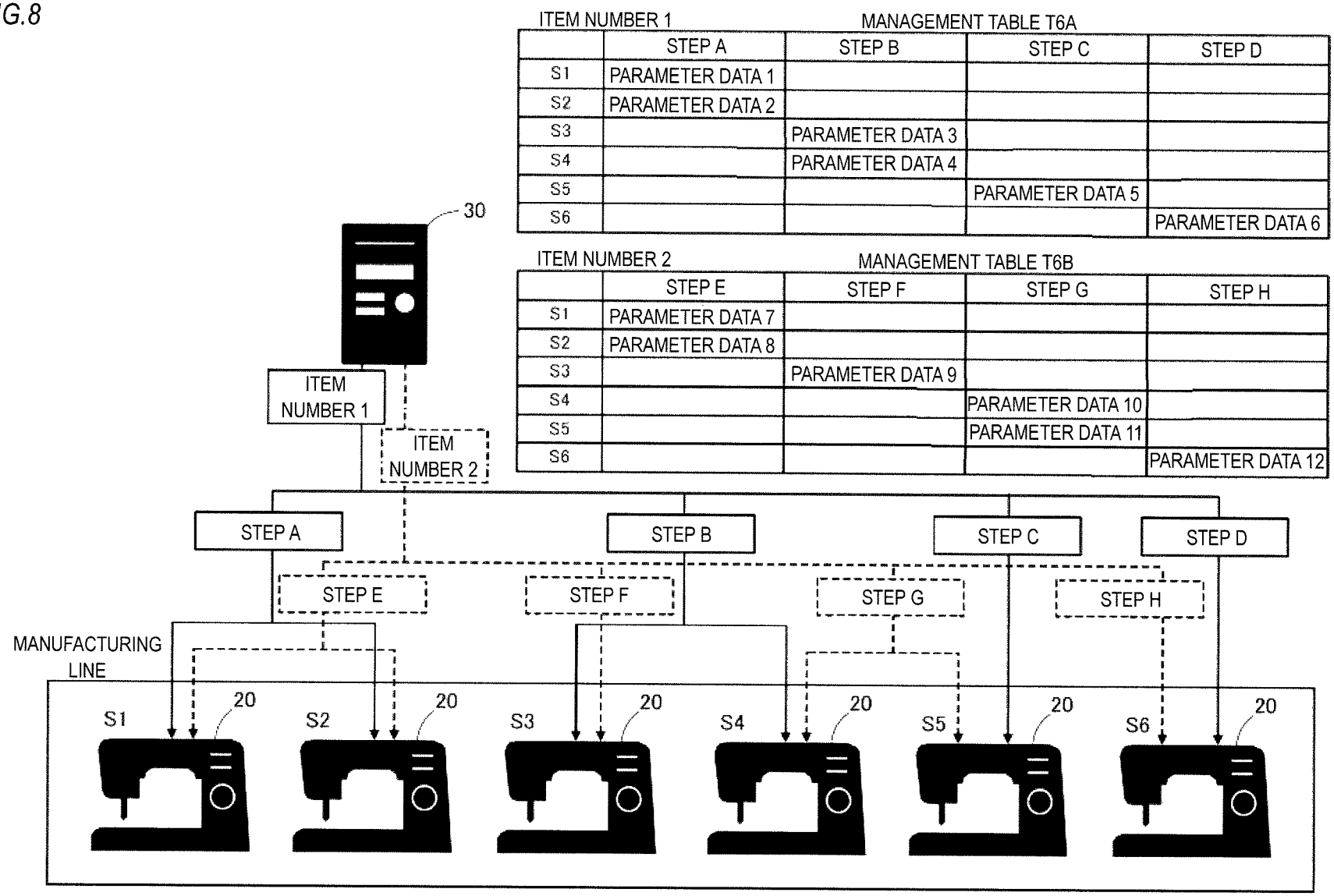
FIG. 8 is a view illustrating an example of data management for each step and item number according to the embodiment.
Figure 9:
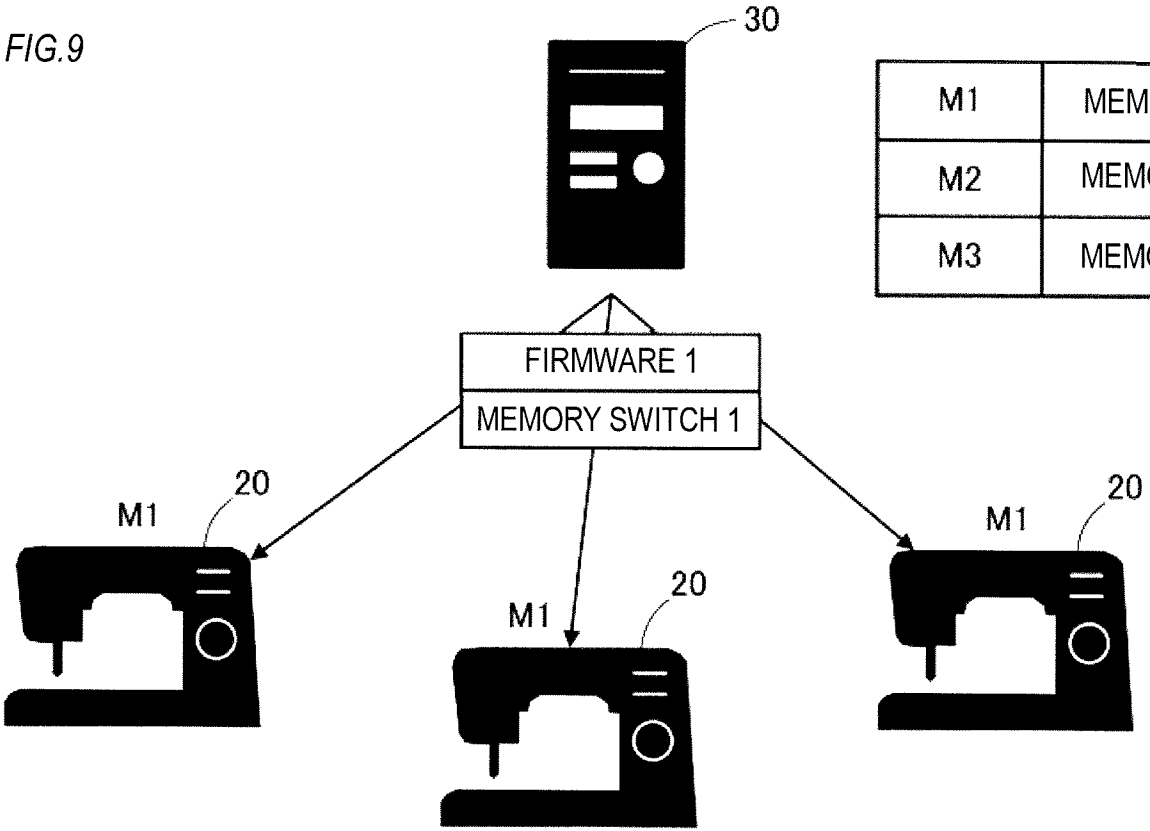
FIG. 9 is a view illustrating an example of data management for each type, according to the embodiment.

Subsequently, data management using the management table will be described with reference to FIGS. 3 to 9. FIG. 3 is a view illustrating an example of the data management for each sewing machine according to the embodiment. FIG. 4 is a view illustrating an example of the data management for each step according to the embodiment. FIG. 5 is a view illustrating an example of the data management for each item number according to the embodiment. FIG. 6 is a view illustrating an example of the data management for each operator according to the embodiment. FIG. 7 is a view illustrating another example of the data management for each operator according to the embodiment. FIG. 8 is a view illustrating an example of the data management for each step and item number according to the embodiment. FIG. 9 is a view illustrating an example of the data management for each type according to the embodiment.

As illustrated in FIG. 3, the management device 30 can separately manage operator data for each sewing machine 20. In this case, serial numbers of each sewing machine 20 are registered in a management table T1, and the parameter data is allocated for each serial number. For example, the parameter data 1 to 3 are respectively allocated to the serial numbers S1 to S3. Therefore, the parameter data 1 to 3 that correspond to the serial numbers S1 to S3 are simultaneously delivered to the sewing machine 20 from the management device 30. Accordingly, it is possible to adjust the adjustment function of the seam by the adjustment amount corresponding to an individual difference of the sewing machine 20.

As illustrated in FIG. 4, the management device 30 can also separately manage the parameter data for each step. In this case, serial numbers of each sewing machine 20 are registered in a management table T2, and the parameter data is allocated for each step. For example, the parameter data 1 and 2 are allocated to step A of the serial numbers S1 and S2, the parameter data 3 and 4 are allocated to step B of the serial numbers S3 and S4, the parameter data 5 is allocated to step C of the serial number S5, and the parameter data 6 is allocated to step D of the serial number S6, respectively. Therefore, the parameter data 1 to 6 that correspond to the serial numbers S1 to S6 are delivered to the sewing machine 20 in steps A to D from the management device 30. Accordingly, it is possible to adjust the adjustment function of the seam by the adjustment amount appropriate for each of the steps A to D.

As illustrated in FIG. 5, the management device 30 can also separately manage the parameter data for each item number. In this case, serial numbers of each sewing machine 20 are registered in a management table T3, and the parameter data is allocated for each item number. For example, the parameter data 1 is allocated to an item number 1 of serial numbers S1 to S3, and the parameter data 2 is allocated to an item number 2 of serial numbers S1 to S3, respectively. Therefore, the parameter data 1 and 2 are simultaneously delivered according to the item numbers 1 and 2 to the sewing machine 20 from the management device 30. Accordingly, it is possible to adjust the adjustment function of the seam by the adjustment amount appropriate for each of the item numbers 1 and 2.

In a case where the item number is to be switched, the parameter data can be delivered to each of the sewing machines 20 as an administrator specifies the item number. In addition, instead of specifying the item number, it is also possible to read the item number from a workpiece RF tag on the sewing machine 20 side, and to separately deliver the parameter data to each of the sewing machines 20. Accordingly, it is possible to make the adjustment function of the seam variable according to the item number of the sewing target carried into the sewing machine 20. In addition, the parameter data may not be unified for each item number. For example, the parameter data 1 may be allocated to the item number 1 of the serial number S1, and the parameter data 3 may be allocated to the item number 1 of the serial number S2, respectively.

As illustrated in FIG. 6, the management device 30 can also separately manage the parameter data for each operator. In this case, the serial numbers of each sewing machine 20 are registered in the management table T4, and the parameter data is allocated for operator identification information for identifying the operator of each sewing machine 20. For example, the parameter data 1, 4, and 1 are allocated to the operators 1 to 3 of the serial number S1, the parameter data 2, 5, and 5 are allocated to the operators 1 to 3 of the serial number S2, and the parameter data 3, 6, and 6 are allocated to the operators 1 to 3 of the serial number S3, respectively. Therefore, when the operators 1 to 3 are allocated to the sewing machine 20 of the serial numbers S1 to S3, the parameter data 1, 5, and 6 are simultaneously delivered from the management device 30 to the sewing machine 20 according to the operator identification information. Accordingly, it is possible to adjust the adjustment function of the seam by the adjustment amount corresponding to the skill of the operator.

In a case where the operator is to be switched, the parameter data can be delivered to each sewing machine 20 as the administrator specifies the operator. In addition, instead of specifying the operator, it is also possible to read the operator identification information from the RF tag, such as an employee ID card of the operator on the sewing machine 20 side, and to separately deliver the parameter data to each sewing machine 20. Accordingly, it is possible to appropriately make the adjustment function of the seam variable according to the switching of the operator.

As illustrated in FIG. 7, the management device 30 can separately manage the operator data for each sewing machine 20, and can also manage an intrinsic installation value for each operator. In this case, serial numbers of each sewing machine 20 are registered in a management table T5, and the parameter data is allocated for each serial number. In addition, in the management table T5, the operator identification information is registered, and an intrinsic setting position is allocated for operator identification information. For example, the parameter data 1 to 3 are allocated to the serial numbers S1 to S3 respectively, and the maximum stitch speed (limited rotation speed) is allocated to the operators 1 to 3 as an intrinsic setting value. Therefore, when the operators 1 to 3 are allocated to the sewing machine 20 of the serial numbers S1 to S3, the parameter data 1 to 3 that correspond to the serial numbers S1 to S3 are simultaneously delivered from the management device 30 to the sewing machine 20, and the maximum stitch speed corresponding to the operators 1 to 3 is delivered. Accordingly, it is possible to adjust the adjustment function of the seam by the adjustment amount corresponding to the individual difference of the sewing machine 20, and to restrict the sewing machine 20 to the stitch speed corresponding to the skill of the operator.

In a case where the operator is to be switched, the intrinsic installation value can be delivered to each of the sewing machines 20 as the administrator specifies the operator. In addition, instead of specifying the operator, it is also possible to read the operator identification information from the RF tag of the employee ID card of the operator on the sewing machine 20 side, and to separately deliver the intrinsic installation value to each of the sewing machines 20. Accordingly, it is possible to appropriately make the intrinsic setting value, such as the maximum stitch speed of the sewing machine 20, variable according to the switching of the operator.

As illustrated in FIG. 8, the management device 30 can also separately manage the parameter data for each step and item number. In this case, management tables T6A and T6B are prepared for each item number, the serial numbers of each sewing machine 20 are registered in each of the management tables T6A and T6B, and the parameter data is allocated for each step. For example, in the management table T6A of the item number 1, the parameter data 1 and 2 are allocated to step A of the serial numbers S1 and S2, the parameter data 3 and 4 are allocated to step B of the serial numbers S3 and S4, the parameter data 5 is allocated to step C of the serial number S5, and the parameter data 6 is allocated to step D of the serial number S6, respectively. In addition, in the management table T6B of the item number 2, the parameter data 7 and 8 are allocated to step E of the serial numbers S1 and S2, the parameter data 9 is allocated to step F of the serial number S3, the parameter data 10 and 11 are allocated to step G of the serial numbers S4 and S5, and the parameter data 12 is allocated to step H of the serial number S6, respectively.

Therefore, when producing the item number 1, the parameter data 1 to 6 that correspond to the serial numbers S1 to S6 are simultaneously delivered to the sewing machine 20 in steps A to D from the management device 30. In addition, when producing the item number 2, the parameter data 7 to 12 that correspond to the serial numbers S1 to S6 are simultaneously delivered to the sewing machine 20 in steps E to H from the management device 30. Accordingly, it is possible to adjust the adjustment function of the seam by the adjustment amount appropriate for each of the item numbers 1 and 2 and each of the steps A to D. In a case where the item number is to be switched, the parameter data can be delivered to each of the sewing machines 20 as the administrator specifies the item number. In addition, instead of specifying the item number, it is also possible to read the item number from the workpiece RF tag on the sewing machine 20 side, and to separately deliver the parameter data to each of the sewing machines 20.

In addition, in the above-described management table, in addition to managing the parameter data as the sewing machine data, vector pattern data, continuous sewing data, and cycle sewing data may also be managed. As the parameter data, parameters, such as feed dog height, feed pitch, feed trajectory, pressing pressure, and thread tension adjusted for each sewing machine 20 are included, and considering the individuality of each sewing machine 20, the adjustment function of the seam is separately managed. Embroidery patterns and automatic sewing data are included as vector pattern data, continuous sewing data, and cycle sewing data, and the sewing functions necessary for the sewing machine 20 are managed.

As illustrated in FIG. 9, a management table T7 for managing the memory switch, the firmware, or the like, for each type may be prepared. In the management table T7, a type number is registered, and the memory switch and the firmware are registered for each type of the sewing machine 20. The memory switch is various operation programs of the sewing machine 20, and the firmware is control software of various sewing machines. For example, the memory switches 1 to 3 and the firmware 1 to 3 are allocated to type numbers M1 to M3, respectively. Therefore, the firmware or the like corresponding to the type numbers M1 to M3 is simultaneously delivered to the sewing machine 20 from the management device 30. Accordingly, the firmware and the like can be updated according to the type of the sewing machine 20.

Figure 10:
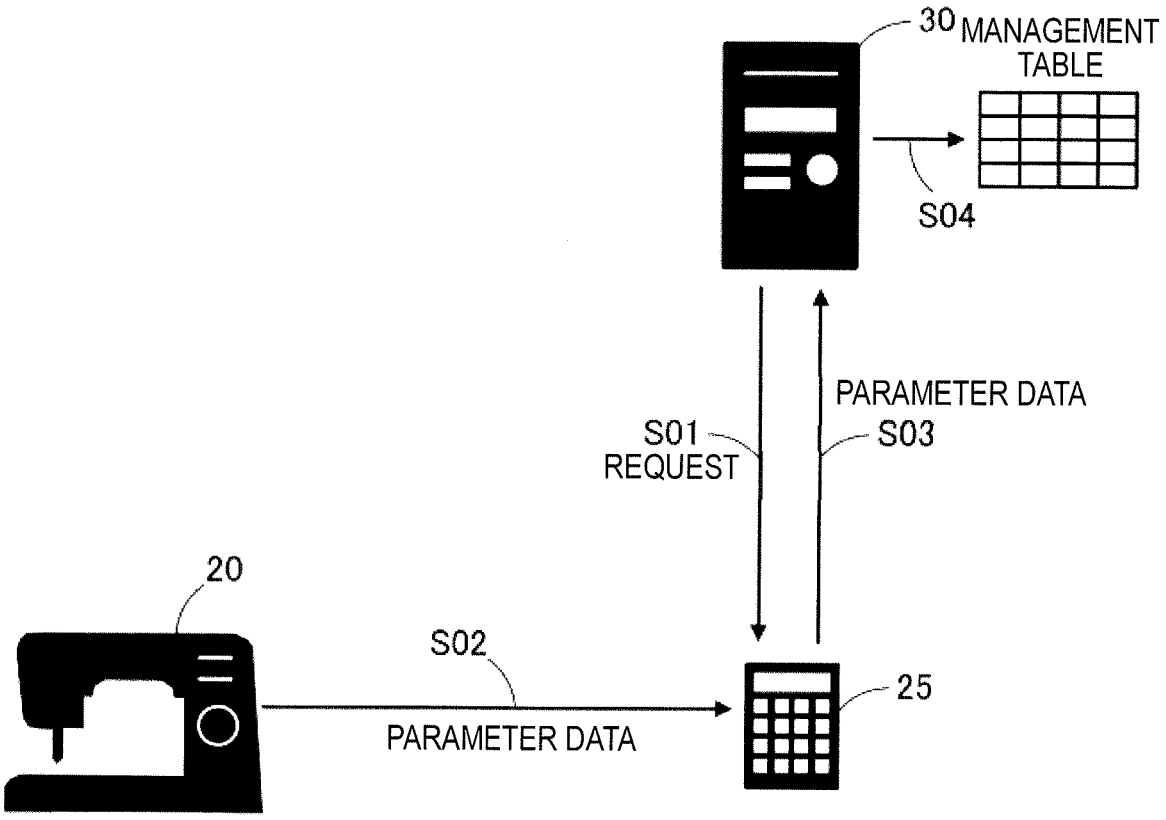
FIG. 10 is a view illustrating an example of uploading of parameter data according to the embodiment.
Figure 11:
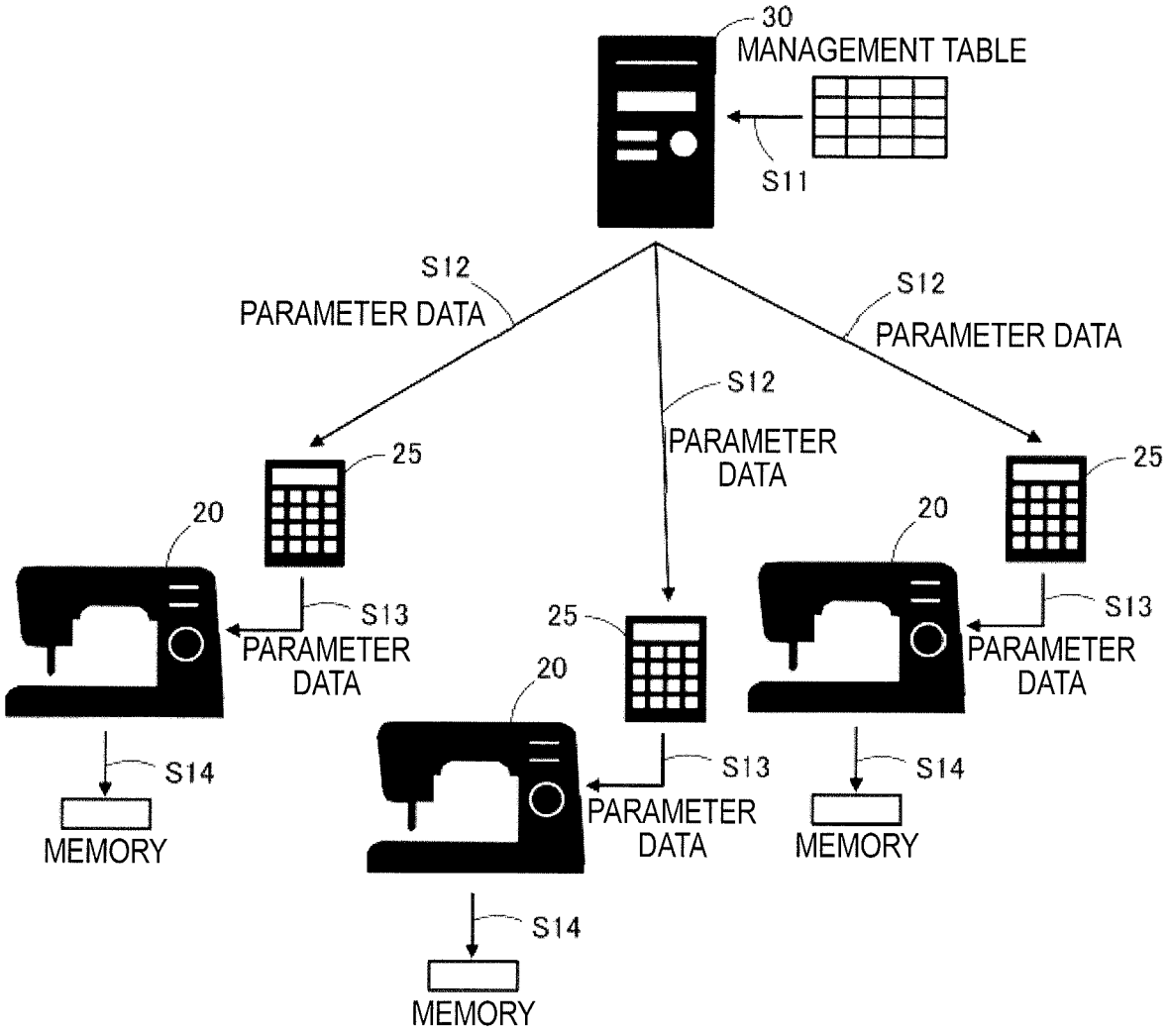
FIG. 11 is a view illustrating an example of simultaneous delivering of the parameter data according to the embodiment.
Figure 12:
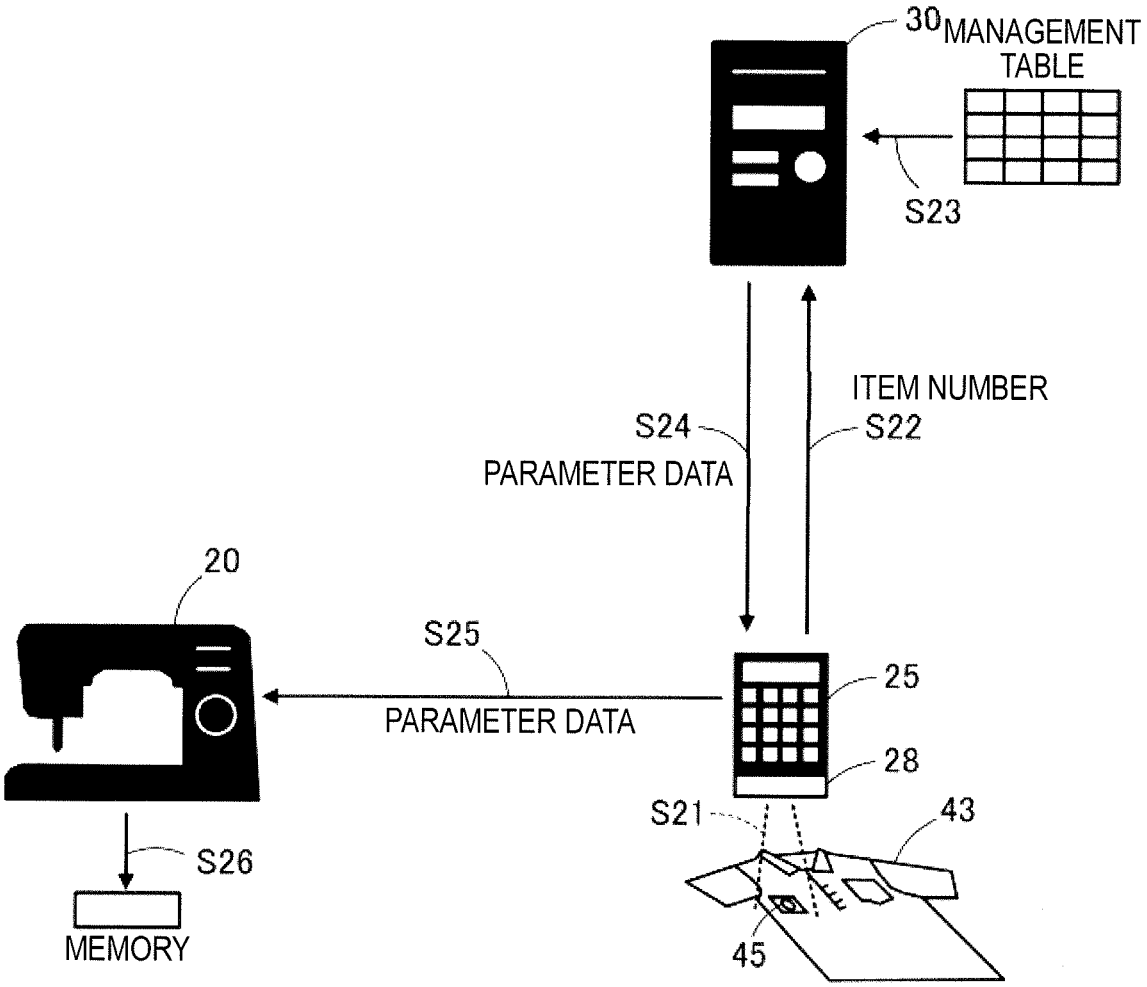
FIG. 12 is a view illustrating an example of real-time delivering of the parameter data according to the embodiment.

Next, bidirectional communication of the sewing system will be described with reference to FIGS. 10 to 12. FIG. 10 is a view illustrating an example of uploading of the parameter data according to the embodiment. FIG. 11 is a view illustrating an example of simultaneous delivering of the parameter data according to the embodiment. FIG. 12 is a view illustrating an example of real-time delivering of the parameter data according to the embodiment. Here, the parameter data is described as an example of the sewing machine data, but other sewing machine data can also be uploaded and delivered in the same manner. In addition, the description will be given on the assumption that the parameter data of the sewing machine is managed for each item number by the management device. Further, the management device and the sewing machine are configured to communicate with each other via the terminal, but it is possible to omit the terminal by providing the transmitting and receiving function to the sewing machine. In addition, in FIGS. 10 to 12, for the convenience of description, the reference numerals in FIG. 2 are appropriately used for description.

As illustrated in FIG. 10, in the uploading of the parameter data, the request is simultaneously sent from the collection unit 33 of the management device 30 to the terminal 25 of each sewing machine 20 (step S01), and the current parameter data is obtained from the memory 21 of the sewing machine 20 by the terminal 25 (step S02). The parameter data is uploaded from the terminal 25 to the management device 30 and collected by the collection unit 33 (step S03). When the current parameter data is collected from each sewing machine 20 by the collection unit 33, the management table is referred to by the management unit 31, and the step and the item number of the workpiece to which each sewing machine 20 is allocated are specified from the serial number of each sewing machine 20.

In this manner, since the management device 30 manages each sewing machine 20 for each step and item number in the management table, it is possible to recognize the parameter data uploaded from the sewing machine 20 is the parameter data of the sewing machine 20 for which item number in which step. Accordingly, it is not necessary to give the identification information indicating the step or the item number to the parameter data on the sewing machine 20 side and to notify the management device 30. In addition, the current parameter data of each sewing machine 20 is managed for each step and item number by the management unit 31 such that the same parameter data is used again for each sewing machine 20 at the same step as the current step and at the next production of the item number (step S04).

In addition, in the uploading of the parameter data, the parameter data adjusted by sample sewing of each sewing machine 20 may be uploaded to the management device 30. In a case where different sewing machines 20 are used for sample sewing for the actual operation, the parameter data adjusted by the sample sewing is uploaded to the management device 30, and the parameter data may be applied to the sewing machine 20 for the actual operation. In the parameter data of the sample sewing, in a case where the adjustment of the sewing machine 20 for the actual operation is insufficient, the parameter data adjusted again by the sewing machine 20 for the actual operation is uploaded to the management device 30 and registered in the management table for each step and item number.

As illustrated in FIG. 11, in downloading of the parameter data, the parameter data of each sewing machine 20 is separately managed for each step and item number by using the management table in the management unit 31 of the management device 30. The parameter data for the sewing machine 20 which is the delivery target is selected by the management unit 31 according to a delivery instruction, (step S11), and the parameter data is simultaneously distributed to the terminal 25 of the sewing machine 20 in each step according to the item number in the delivery unit 32, (step S12). When the parameter data is received by the terminal 25, the parameter data is transferred from the terminal 25 to the sewing machine 20 (step S13), and the parameter data is set in the memory 21 of the sewing machine 20 (step S14).

Accordingly, in order to simultaneously switch the production item number in a specific sewing line or a plurality of sewing lines, it is possible to automatically adjust the management function of the seam with respect to the plurality of sewing machines 20 on the management device 30 side. Accordingly, it is possible to start operating the plurality of sewing machines 20 during a short period of time, and it is possible to reduce the work burden of the operator. In addition, it is possible to appropriately adjust the sewing machines one by one independently of the skill of the operator, and it is also possible to prevent setting mistakes by the operator. By managing the parameter data of each sewing machine 20 for each step and item number, each sewing machine 20 can be adjusted to a condition appropriate for the step and the item number.

In addition, as illustrated in FIG. 12, in a case of mixing and producing the plurality of item numbers in the same sewing line, the parameter data may be delivered in real time. In the real-time delivery of the parameter data, the reading unit 28 corresponding to the RF tag is provided in each terminal 25, and the reading unit 28 reads the item number of the workpiece 43 from an RF tag 45 of the workpiece 43 carried into the sewing machine 20 (step S21). When the item number is sent from the terminal 25 to the management device 30 (step S22), the management unit 31 selects the parameter data of the sewing machine 20 according to the item number (step S23), and the parameter data is sent back to the terminal 25 by the delivery unit 32 (step S24).

In addition, when the parameter data is received by the terminal 25, the parameter data is transferred from the terminal 25 to the sewing machine 20 (step S25), and the parameter data is set in the memory 21 of the sewing machine 20 (step S26). In this manner, the delivery unit 32 can not only simultaneously deliver the parameter data to the plurality of sewing machines 20, but also separately deliver the parameter data to the plurality of sewing machines 20 according to the item number. Accordingly, since the parameter data is separately delivered to the sewing machine 20 each time the item number is changed, it is possible to make the real-time adjustment function of the seam variable according to the item number of the sewing target 43 carried into the sewing machine 20.

As described above, in the sewing system 11 according to the embodiment, the parameter data is simultaneously delivered to the plurality of sewing machines 20 from the management device 30, and the adjustment function of the seam of each sewing machine 20 is automatically adjusted by an appropriate adjustment amount. For each sewing machine 20, the operator does not need to manually adjust the adjustment function of the seam, and the operator does not need to operate the sewing machine 20 to obtain the parameter data. Accordingly, even when the plurality of sewing machines 20 are installed in the sewing line, it is possible to shorten the work time of the adjustment work of the plurality of sewing machines 20, and to improve the work efficiency, and it is possible to prevent the setting mistakes due to carelessness of the operator.

In addition, in the embodiment, the management unit is configured to manage the parameter data of the plurality of sewing machines for each step, each item number, each operator, each step and item number, but the configuration is not limited thereto. The management unit may be configured to separately manage the parameter data of the sewing machine, and the parameter data may be managed by appropriately combining the step, the item number, and the operator.

Further, in the embodiment, the sewing machine and the management device are configured to communicate with each other via the terminal connected to the sewing machine, but the configuration is not limited thereto. The sewing machine and the management device may communicate with each other by using the transmitting and receiving function of the tablet, the operation panel and the like connected to the sewing machine, and the sewing machine and the management device may communicate with each other by the transmitting and receiving function embedded in the sewing machine.

In addition, in the embodiment, feed dog height, feed pitch, feed trajectory, pressing pressure, and thread tension are described as examples of the adjustment function of the seam, but the configuration is not limited thereto. The adjustment function of the seam may be any function as long as the function is used for the adjustment of the seam. In addition, the adjustment function of the seam is adjusted by operating the adjustment mechanism of each part of the sewing machine.

Further, in the embodiment, a configuration has been described in which the sewing machine data is simultaneously delivered from the management device to the plurality of sewing machines and the sewing machine data is uploaded from each sewing machine to the management device, but the configuration is not limited to thereto. The sewing system may be configured such that the sewing machine data is simultaneously delivered at least from the management device to the plurality of sewing machines.

In addition, in the embodiment, parameter data, vector pattern data, memory switch, continuous stitch data, cycle sewing data, and firmware are described as examples of the sewing machine data, but the configuration is not limited thereto. The sewing machine data may be any data as long as the data is set to each sewing machine.

Further, in the embodiment, it is not necessary for the delivery unit to deliver all sewing machine data, but only the parameter data may be delivered, and in addition to the parameter data, at least one of vector pattern data, memory switch, continuous sewing data, cycle sewing data, and firmware may be delivered. In addition, the delivery timing of each sewing machine data may be the same, or may be different for each sewing machine data.

In addition, in the embodiment, the RF tag is described as an example of the tag used for the real-time delivery of the parameter data, but the configuration is not limited thereto. The tag may be any tag as long as the tag can specify the item number of the sewing target, for example, a two-dimensional code or the like. Further, instead of providing the tag in the sewing target, image processing or the like may be performed on the sewing target to specify the item number.

Further, in the embodiment, the sewing line is not limited to the line for producing the clothes. The sewing line may be any line as long as the line is for producing the workpiece, for example, shoes, bags, futons, small items, and the like may be produced.

Further, the program of the embodiment may be stored in a storage medium. The storage medium is not particularly limited, but may be a non-transitory recording medium, such as an optical disk, a magneto-optical disk, a flash memory, or the like.

Further, although the embodiment and the modification example of the invention have been described, as another embodiment of the invention, the above-described embodiment and the modification example may be combined in whole or in part.

Further, the embodiment of the invention is not limited to the above-described embodiment and the modification example, and various modifications, substitutions, and changes may be made without departing from the spirit of the technical idea of the present invention. Furthermore, when the technical idea of the present invention can be realized in another manner by the advancement of technology or another derivative technology, the invention may be realized using the method. Therefore, the range of the claims covers the entire embodiment that can be included in the scope of the technical idea.

Furthermore, in the above-described embodiment, there is provided a sewing system in which a plurality of sewing machines are managed by a management device, in which the plurality of sewing machines include a memory for storing parameter data obtained by digitizing an adjustment amount of an adjustment function of a seam, and an adjustment unit that adjusts the adjustment function of the seam by the adjustment amount corresponding to the parameter data in the memory, and in which the management device includes a management unit that separately manages the parameter data of the plurality of sewing machines, and a delivery unit that simultaneously delivers the parameter data to each of sewing machines. According to the configuration, the parameter data is simultaneously delivered to the plurality of sewing machines from the management device, and the adjustment function of the seam of each sewing machine is automatically adjusted by an appropriate adjustment amount. For each sewing machine, the operator does not need to manually adjust the adjustment function of the seam, and the operator does not need to operate the sewing machine to obtain the parameter data. Accordingly, even when the plurality of sewing machines are installed in the sewing line, it is possible to shorten the work time of the adjustment work of the plurality of sewing machines, and to improve the work efficiency, and it is possible to prevent the setting mistakes due to carelessness of the operator.

As described above, the present invention has an effect that it is possible to improve the working efficiency and to prevent the setting mistakes by the operator, and is particularly useful for the sewing system, the sewing machine, and the management device for sewing clothes.

The invention claimed is:

1. A sewing system comprising:

a plurality of sewing machines arranged in a sewing line, the sewing line including a plurality of steps to produce a work piece, wherein each sewing machine of the plurality of sewing machines configured to perform at least one step of the plurality of steps of the sewing line; and a management device including a processor that manages the plurality of sewing machines, each of the plurality of sewing machines including:

a memory for storing parameter data obtained by digitizing an adjustment amount of an adjustment function of a seam, the parameter data corresponding to the at least one step of the plurality of steps of the sewing line for the sewing machine to perform; and one of a feed dog height adjustor, a feed pitch adjustor, a feed trajectory adjustor, a pressing pressure adjustor, and a thread tension adjustor that adjusts the adjustment function of the seam by the adjustment amount corresponding to the parameter data in the memory; and the processor of the management device further:

separately manages the parameter data of the plurality of sewing machines for each step of the plurality of steps of the sewing line in a first management table; and simultaneously delivers the parameter data managed in the first management table to each of the plurality of sewing machines configured to perform at least one step of the plurality of steps of the sewing line, and a plurality of terminals, wherein each of the plurality of sewing machines are connected to a respective terminal of the plurality of terminals such that each terminal is connected to the management device, and such that the plurality of sewing machines are capable of communicating bidirectionally, wherein each terminal of the plurality of terminals includes:

a reading unit that reads an item number from an RF tag of a sewing target carried into the sewing machine, and that reads operator identification information from an RF tag of an employee ID card of an operator of the sewing machine, wherein the processor of the management device further collects current parameter data from each of the plurality of sewing machines, and manages the current parameter data of each of the plurality of sewing machines in the first management table, wherein the current parameter data is collected by the processor of the management device from each sewing machine of the plurality of sewing machines that are used for a next production for each sewing machine of the plurality of sewing machines, wherein the current parameter data is uploaded as uplink data from each sewing machine of the plurality of sewing machines to the processor of the management device according to a request simultaneously notified to each sewing machine of the plurality of sewing machines from the processor of the management device, and wherein the processor for the management device registers a memory switch and a firmware for each type of sewing machine of the plurality of sewing machines in a second management table, the first management table different from the second management table, the memory switch storing operation programs of the sewing machine, the firmware is control software of the sewing machine of the plurality of sewing machines, the firmware corresponding to the type of sewing machine being simultaneously delivered to each sewing machine from the management device, and the memory switch being different from the firmware.

2. The sewing system according to claim 1, wherein the processor of the management device further:

manages the parameter data of the plurality of sewing machines for each item number; and simultaneously delivers the parameter data to each of the sewing machines according to the item number.

3. The sewing system according to claim 2, wherein the processor of the management device further:

manages the parameter data of the plurality of sewing machines for each operator; and simultaneously delivers the parameter data to each of the sewing machines according to the operator identification information for identifying the operator of each of the sewing machines read out by each reading unit.

4. The sewing system according to claim 2, wherein the processor of the management device further:

separately delivers the parameter data to each of the plurality of sewing machines according to the item number read by each reading unit corresponding to a terminal of the plurality of terminals.

5. The sewing system according to claim 4, wherein the processor of the management device further:

manages the parameter data of the plurality of sewing machines for each operator; and simultaneously delivers the parameter data to each of the sewing machines according to the operator identification information for identifying the operator of each of the sewing machines read out by each reading unit.

6. The sewing system according to claim 1, wherein the processor of the management device further:

manages the parameter data of the plurality of sewing machines for each operator; and simultaneously delivers the parameter data to each of the sewing machines according to the operator identification information for identifying the operator of each of the sewing machines automatically read out by each reading unit.

7. The sewing system according to claim 1, wherein the processor of the management device further:

simultaneously delivers the firmware and vector pattern data indicating an embroidery pattern, the memory switch indicating a sewing machine control option, continuous stitch data for controlling automatic sewing of a continuous sewing, and cycle stitch data for controlling an automatic sewing of a pattern seamer, in addition to the parameter data, to the plurality of sewing machines.

8. The sewing system according to claim 1, wherein the processor of the management device updates the firmware of each sewing machine of the plurality of sewing machines according to a type of the sewing machine.

9. A sewing machine managed by a management device, comprising:

a memory that stores parameter data obtained by digitizing an adjustment amount of an adjustment function of a seam; and one of a feed dog height adjustor, a feed pitch adjustor, a feed trajectory adjustor, a pressing pressure adjustor, and a thread tension adjustor that adjusts the adjustment function of the seam with an adjustment amount corresponding to the parameter data in the memory, wherein the parameter data stored in the memory is parameter data of a plurality of sewing machines separately managed in a first management table by the management device including a processor, the parameter data of the plurality of sewing machines managed in the first management table being simultaneously delivered, the sewing machine being one of the plurality of sewing machines, wherein the plurality of sewing machines are arranged in a sewing line, the sewing line including a plurality of steps to produce a work piece, wherein each sewing machine of the plurality of sewing machine configured to perform at least one step of the plurality of steps of the sewing line, wherein the processor of the management device separately manages the parameter data of the plurality of sewing machines in the first management table for each step of the plurality of steps of the sewing line, wherein the parameter data corresponds to the at least one step of the plurality of steps of the sewing line for the sewing machine to perform, wherein the parameter data of the plurality of the sewing machines is stored in respective memory of the plurality of sewing machines, wherein an adjustment function of a seam of each of the plurality of the sewing machines is adjusted by the parameter data in the respective memory, wherein each of the plurality of sewing machines are connected to a respective terminal of a plurality of terminals such that each terminal is connected to the processor of the management device, and such that the plurality of sewing machines are capable of communicating bidirectionally, wherein each terminal of the plurality of terminals includes:

a reading unit that reads an item number from an RF tag of a sewing target carried into the sewing machine, and that reads operator identification information from an RF tag of an employee ID card of an operator of the sewing machine, wherein the processor of the management device further collects current parameter data from each of the plurality of sewing machines, and manages the current parameter data of each of the plurality of sewing machines in the first management table, wherein the current parameter data are collected by the processor of the management device from each sewing machine of the plurality of sewing machines that are used for a next production for each sewing machine of the plurality of sewing machines, wherein the current parameter data is uploaded as uplink data from each sewing machine of the plurality of sewing machines to the processor of the management device according to a request simultaneously notified to each sewing machine of the plurality of sewing machines from the processor of the management device, and wherein the processor for the management device registers a memory switch and a firmware for each sewing machine of the plurality of sewing machines in a second management table, the first management table different from the second management table, the memory switch storing operation programs of the sewing machine, the firmware controlling software of the sewing machine, the firmware corresponding to each type of sewing machine being simultaneously delivered to each sewing machine from the management device, and the memory switch different from the firmware.

10. A management device that manages a plurality of sewing machines, comprising:

a processor that separately manages parameter data of the plurality of sewing machines in a first management table obtained by digitizing an adjustment amount of an adjustment function of a seam; and simultaneously delivers the parameter data managed in the first management table to each sewing machine, wherein the adjustment function of the seam is adjusted by the adjustment amount corresponding to the parameter data with respect to the plurality of sewing machines by simultaneously delivering the parameter data, wherein the plurality of sewing machines are arranged in a sewing line, the sewing line including a plurality of steps to produce a work piece, wherein each sewing machine of the plurality of sewing machines configured to perform at least one step of the plurality of steps of the sewing line, wherein the processor of the management device separately manages the parameter data of the plurality of sewing machines for each step of the plurality of steps of the sewing line in the first management table, wherein the parameter data corresponds to the at least one step of the plurality of steps of the sewing line for the sewing machine to perform, wherein each of the plurality of sewing machines are connected to a respective terminal of a plurality of terminals such that each terminal is connected to the processor of the management device, and such that the plurality of sewing machines are capable of communicating bidirectionally, wherein each terminal of the plurality of terminals includes:

a reading unit that reads an item number from an RF tag of a sewing target carried into the sewing machine, and that reads operator identification information from an RF tag of an employee ID card of an operator of the sewing machine, wherein the processor of the management device delivers according to operator identification information for identifying the operator of each of the sewing machines read out by each reading unit of each of the plurality of sewing machines, wherein the processor of the management device collects current parameter data from each of the plurality of sewing machines, and manages the current parameter data of each of the plurality of sewing machines in the first management table, wherein the current parameter data are collected by the processor of the management device from each sewing machine of the plurality of sewing machines that are used for a next production for each sewing machine of the plurality of sewing machines, wherein the current parameter data is uploaded as uplink data from each sewing machine of the plurality of sewing machines to the processor of the management device according to a request simultaneously notified to each sewing machine of the plurality of sewing machines from the processor of the management device, and wherein the processor for the management device registers a memory switch and a firmware for each type of sewing machine of the plurality of sewing machines in a second management table, the first management table different from the second management table, the memory switch storing operation programs of the sewing machine, the firmware is control software of the sewing machine of the plurality of sewing machines, the firmware corresponding to the type of sewing machine being simultaneously delivered to each sewing machine from the management device, and the memory switch different from the firmware.

* * * * *